United States Patent [19]

Kawai et al.

[11] 4,325,313

[45] Apr. 20, 1982

[54] AUTOMATIC EMBROIDERY SEWING MACHINE

[75] Inventors: Taneichi Kawai; Kouji Nishida, both of Anjyo; Osamu Miyake, Toyota; Shigemitsu Hamajima, Oobu, all of Japan

[73] Assignee: Aisin Seiki Kabushiki Kaisha, Aichi, Japan

[21] Appl. No.: 150,024

[22] Filed: May 15, 1980

[30] Foreign Application Priority Data

May 21, 1979 [JP] Japan ..... 54/67896
Jun. 14, 1979 [JP] Japan ..... 54/75062

[51] Int. Cl.[3] ..... D05C 5/04

[52] U.S. Cl. ..... 112/103; 112/121.12; 112/221

[58] Field of Search ..... 112/103, 102, 121.12, 112/221, 158 E, 78, 86

[56] References Cited

U.S. PATENT DOCUMENTS

| | | | |
|---|---|---|---|
| 4,000,706 | 1/1977 | Kreissl et al. | 112/221 |
| 4,135,459 | 1/1979 | Manabe et al. | 112/121.12 |
| 4,201,144 | 5/1980 | Manabe et al. | 112/121.12 |
| 4,208,975 | 6/1980 | Teetz | 112/103 X |

FOREIGN PATENT DOCUMENTS

| | | | |
|---|---|---|---|
| 45-1108 | 1/1970 | Japan | 112/103 |

*Primary Examiner*—Peter P. Nerbun

*Attorney, Agent, or Firm*—Sughrue, Mion, Zinn, Macpeak and Seas

[57] ABSTRACT

A sewing machine is provided which automatically drives an embroidery frame in two directions of X- and Y-axes during the time a sewing needle is disengaged from a cloth to be worked. An X-axis drive system and a Y-axis drive system are provided which drive the embroidery frame in the directions of the X- and Y-axes in a conventional manner. The machine includes an electromagnetic clutch mechanism which selectively engages or disengages a needle bar with or from a needle bar drive system in order to permit an increased stroke selectively for which the embroidery frame is driven for each stitch. Additionally, an electronic control system is provided which energizes the electromagnetic clutch mechanism to disengage the needle bar from the needle bar drive system whenever either one of X-axis and Y-axis components of the stroke contained in an embroidery sewing data exceeds a given value, and which deenergizes the clutch mechanism after the termination of driving the embroidery frame and engages the needle bar with the needle bar drive system. If either component of the stroke exceeds the given value, the arm shaft idles to maintain the needle bar at its upper dead center during the time the embroidery frame is being driven. Subsequently, when the drive to the embroidery frame is terminated, a downward movement of the needle bar is allowed.

3 Claims, 7 Drawing Figures

AUTOMATIC EMBROIDERY SEWING MACHINE

BACKGROUND OF THE INVENTION

The invention relates to an automatic embroidery sewing machine, and in particular, to such machine which is provided with an embroidery frame drive mechanism including a plurality of servo motors and also provided with an electronic control system which automatically controls the operation of the drive mechanism in synchronism with the elevating motion of a needle of the machine.

In an embroidery sewing machine including a pair of servo motors which are controlled to produce respective drive outputs in accordance with a storage of strokes of an embroidery frame for each stitch so as to represent components of the motion along two coordinates and in which the outputs are combined to provide a composite motion of the embroidery frame tracing a desired two-dimensional figure in synchronism with an elevating motion of a needle of the machine, the maximum stroke imparted to the embroidery frame for each stitch is limited, for each coordinate component, to the order of 4 mm, for example, since it is not advisable to provide an unduly high capacity of the servo motors. Consequently, a plurality of stitches must be continued one after another for a stroke which exceeds the maximum value. After one embroidery operation is completed, the sewing yarn which extends along the loose courses between parts of a pattern must be removed. The removal is a troublesome operation where an increased number of stitches are involved.

Where the capacity of the servo motors is increased to provide a maximum stroke along each coordinate of 10 mm or greater for each stitch, the length of time required to complete a desired embroidery pattern can advantageously be reduced. However, the proportion of a cloth feed which requires an increased stroke on the order of 10 mm per stitch represents about 10% of all the stitches required for the entire pattern. It will be seen that the provision of servo motors of an increased capacity for such less frequent purposes and a corresponding increase which is required in the output capacity of an associated control circuit are not an efficient way of solution. Hence, it is desirable that an increased maximum stroke for each stitch be provided without requiring an increased size or capacity and an increased speed of operation of an embroidery frame drive system.

It is a first object of the invention to provide an automatic embroidery sewing machine allowing an increased maximum stroke per stitch.

It is a second object of the invention to provide an automatic embroidery sewing machine capable of establishing an increased stroke per stitch while utilizing a usual embroidery frame drive system.

SUMMARY OF THE INVENTION

Above and other objects of the invention will be achieved in accordance with the invention by providing an electromagnetic clutch mechanism which selectively couples a needle bar with a needle bar drive system, and an electronic control system which extracts embroidery frame stroke specifying data from sewing data and comparing X-axis component data and Y-axis component data thereof against respective given values to energize the electromagnetic clutch whenever at least one of these compnents exceeds the associated given value to decouple the needle bar from a needle bar drive system while coupling the needle bar with the drive system again by deenergizing the electromagnetic clutch after the termination of driving the embroidery frame. When neither components exceed their associated given values, the clutch remains deenergized, thus maintaining the needle bar coupled with the drive system.

DESCRIPTION OF PREFERRED EMBODIMENT

Figure 1:
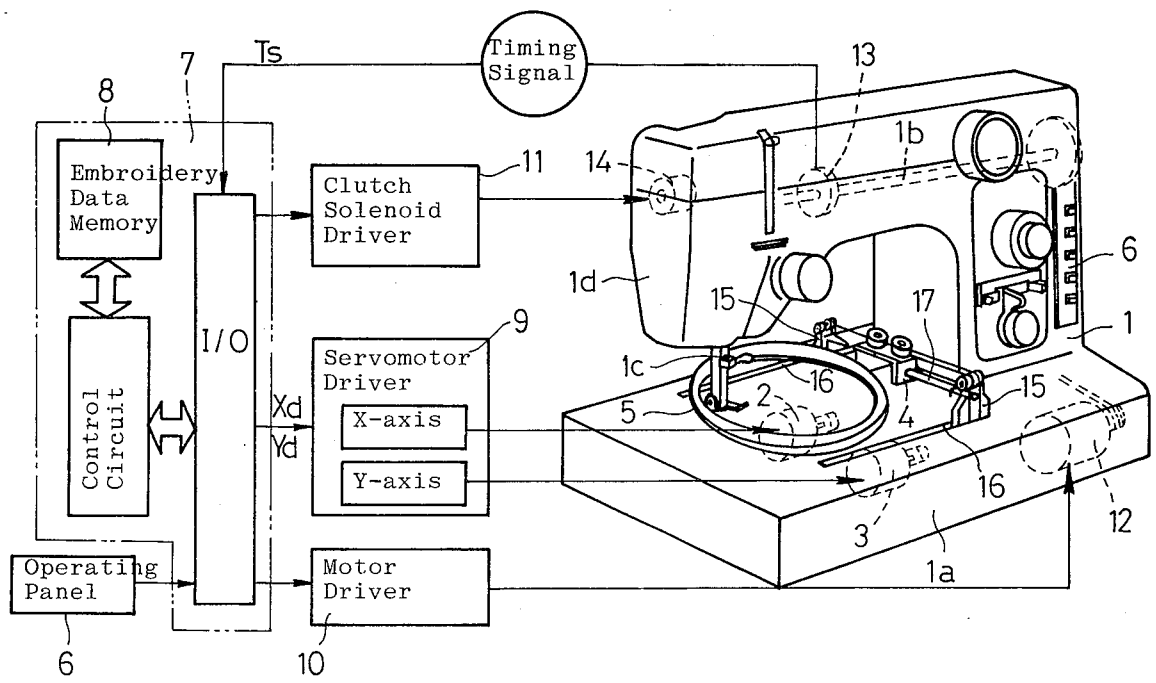
FIG. 1 is a schematic block diagram illustrating the overall arrangement of one preferred embodiment of the invention.
Figure 2:
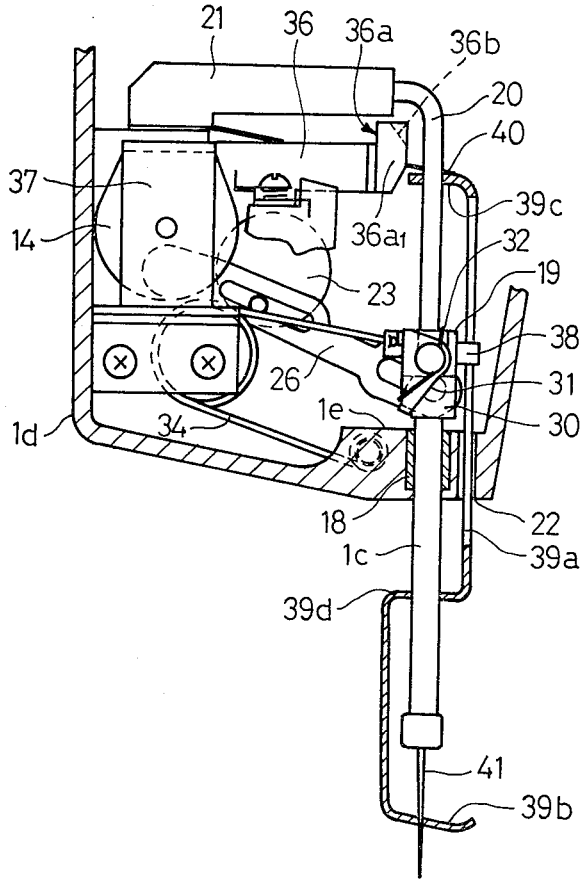
FIG. 2 is an enlarged cross section of an arm of the machine shown in FIG. 1.
Figure 3:
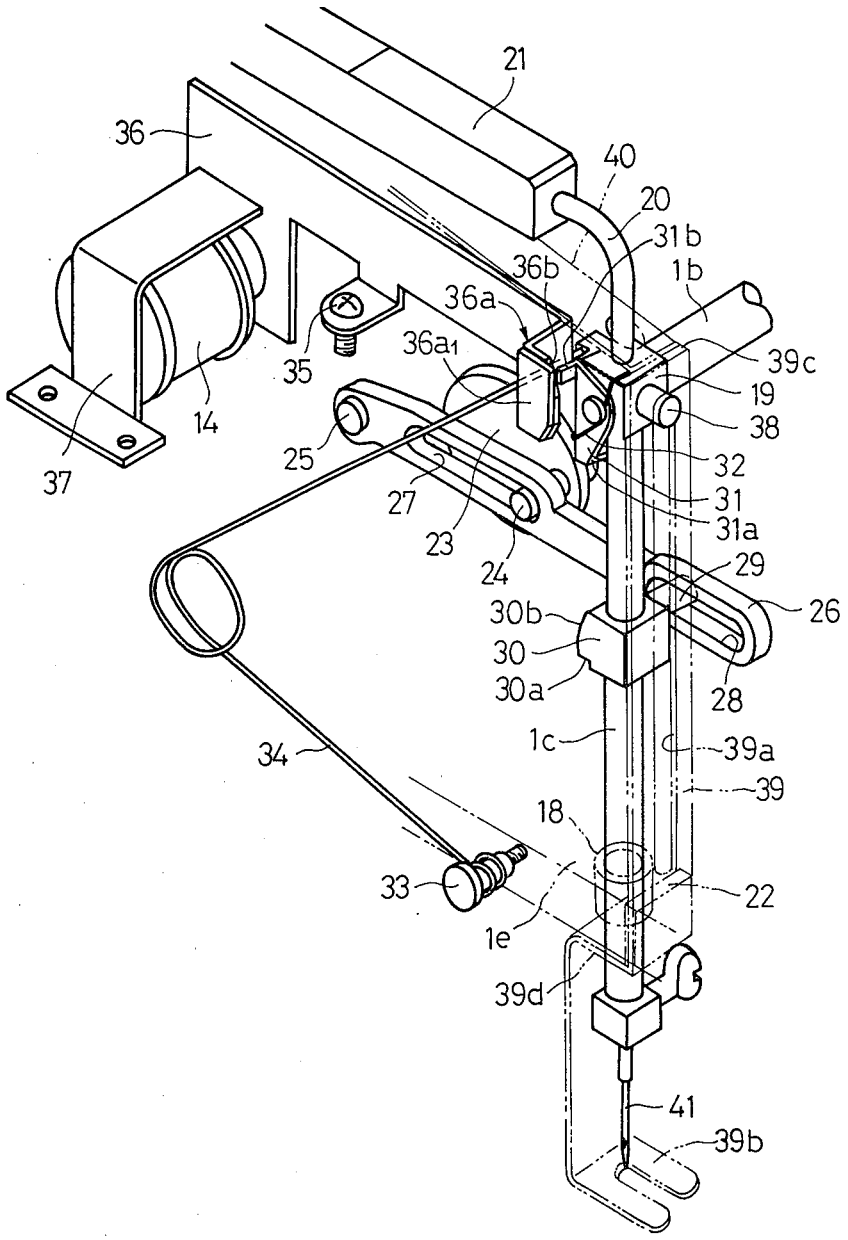
FIG. 3 is an enlarged perspective view of an electromagnetic clutch mechanism which is housed within the arm shown in FIG. 1, the clutch being deenergized.
Figure 4:
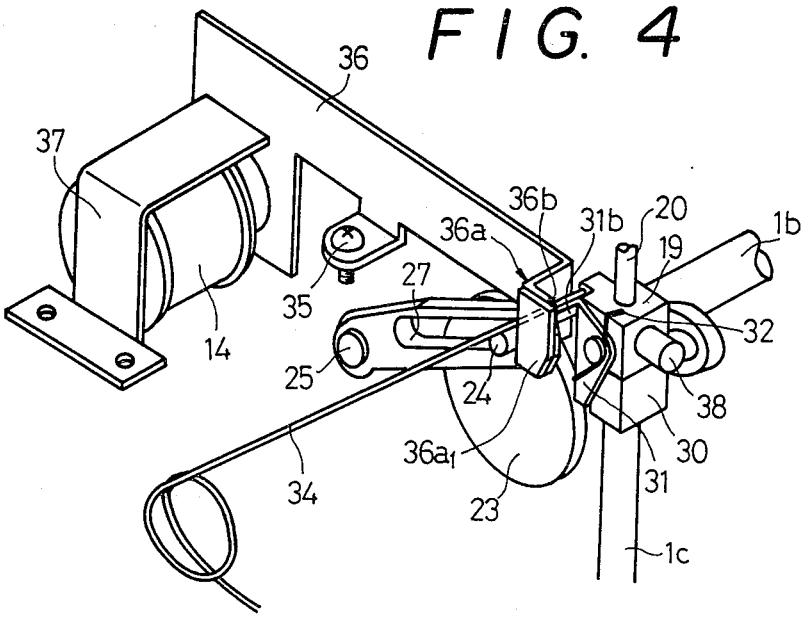
FIG. 4 is an enlarged perspective view of the electromagnetic clutch mechanism, illustrating a condition thereof when the clutch is energized with a needle bar located at its upper dead center and with a drive arm which is driven by an arm shaft located at its upper dead center.

Referring to FIG. 1, there is shown an automatic embroidery sewing machine 1 including a bed 1*a* which houses a pair of servo motors 2, 3 therein. These servo motors are connected, through drive transmitting means, not shown, to an embroidery frame carrier 4 which is disposed on the bed 1*a* so as to impart a motion thereto which traces a desired two-dimensional figure. A corresponding movement of an embroidery frame 5 then takes place in timed relationship with the rotation of an arm shaft 1*b*, or more specifically, during one-half cycle of the oscillating or elevating motion of a needle bar 1*c* when it assumes its upper position. The intermittent drive by the servo motors 2, 3 is controlled by operating keys, not shown, which are provided on an operating panel 6 of the machine 1. In response to such key operation, an electronic control system or a microcomputer 7 which is internally housed therein automatically supplies embroidery data and other control data which are derived from a memory 8 thereof. Such data constitute together a sequential output which is amplified by a plurality of driver circuits 9, 10 and 11. Specifically, the servo motors 2, 3 are controlled by outputs from a servo motor driver circuit 9. A motor driver circuit 10 receives data from the microcomputer 7 and controls a machine motor 12 which is also mounted within the bed 1*a*. The motor 12 drives the arm shaft 1*b*, and a rotation signal generator 13 is associated with the arm shaft to provide a synchronizing signal which is supplied to the microcomputer 7. An arm portion 1*d* internally houses a clutch controlling solenoid 14 which in turn operates through an engaging and disengaging mechanism, to be described later, to halt the motion of the needle bar at an elevated position thereof while causing an idling of the arm shaft 1*b*. The microcomputer 7 also operates to control the energization of the clutch controlling solenoid 14 through a needle bar clutch driver circuit 11.

As a result of such arrangement, the machine operates as follows: As the machine is started, a synchronizing signal $T_s$ is fed back to the microcomputer 7, which responds thereto to operate the servo motors 2, 3 to provide an intermittent motion which is imparted to the embroidery frame 5 in synchronism with the elevating motion of the needle bar 1*c*. During the progress of the embroidery stitching, the memory 8 supplies control data (Xd, Yd) specifying a stroke for a stitch. When a particular stroke exceeds the maximum stroke per revolution of the arm shaft 1*b*, the microcomputer 7 energizes the clutch control solenoid 14 at the elevated position of the needle bar 1*c* to maintain it at its upper position (upper dead center) while allowing the servo motors 2, 3 to continue their driving action. After the arm shaft 1*b* has idly rotated through a required number of revolutions, the elevating motion of the needle bar 1*c* is reinitiated, and the intermittent drive by the servo motors 2, 3 are resumed in synchronized relationship with the oscillating motion of the needle bar.

Drive outputs from the servo motors 2, 3 are transmitted to the embroidery frame carrier 4 through transmitting means, not shown, associated with both the X- and Y-axis components. Specifically, the rotation of the X-axis servo motor 2 is effective to cause a translational movement of a front and a rear rod supporter 15 along a pair of slits 16 formed in the upper surface of the bed 1*a*. The rotation of the Y-axis servo motor 3 is effective to cause a sliding movement of the embroidery frame carrier 4, in a direction perpendicular to the length of the slits 16, along a Y-axis guide rod 17 which is carried at its opposite ends by the rod supporters 15. It is to be understood that the movements in these two perpendicular directions are transmitted through rollers and wires, not shown. An arrangement which controls the servo motors 2, 3 to provide drive outputs along two orthogonal coordinates to provide a composite motion imparted to the embroidery frame 5 so that the latter can trace a desired two-dimensional figure is fully disclosed in U.S. Pat. No. 4,280,420 and will not be specifically described herein, since it has no direct bearing with the understanding of the present invention.

Reference is now made to FIGS. 2 to 5 for a description of means for maintaining the needle bar 1*c* at its elevated position by controlling the energization of the clutch controlling solenoid 14 (hereafter simply referred to as "solenoid"). The bottom of the arm portion 1*d* of the machine is provided with a bearing 1*e* in which a sleeve 18 is fitted. The lower portion of the needle bar 1*c* is slidably carried by the sleeve 18. A guide member 19 which is made hollow over its entire length or over a suitable length thereof from its upper end and having an axial bore which communicates with the hollow cavity thereof is fixedly mounted on the top of the needle bar 1*c* by suitable means. A guide rod 20 extends through the axial bore to be slidable relative to the needle bar 1*c* in the axial direction thereof, and has its upper end supported by support means, schematically illustrated, which is disposed within the arm 1*d* through a guide supporter 21. In this manner, the needle bar 1*c* is supported for oscillating or elevating motion by the guide rod 20 at its upper end and by the sleeve 18 at its lower end. A disc 23 is fixedly mounted on the free end of the arm shaft 1*b*, and fixedly carries a crank pin 24 which is eccentrically located on one major surface thereof. A pin 25 pivotally mounts a drive arm 26 which is formed with an elongate slot 27 which is in turn slidably engaged by the crank pin 24, thus imparting a vertical oscillating motion to the drive arm 26 as the arm shaft 1*b* rotates. Adjacent to its end remote from the pin 25, the drive arm 26 is formed with another or front slot 28 which is slidably engaged by a pin 29 which is fixedly mounted on a slider 30 so as to extend horizontally. The slider 30 is slidably disposed on the needle bar 1*c*, and is capable of an elevating motion along the needle bar 1*c* as the drive arm 26 oscillates. However, as will be described shortly, when the slider 30 is coupled in an integral manner with the guide member 19 by an electromagnetic clutch mechanism which is disposed on the guide member 19, the oscillating motion of the drive arm 26 causes an elevating motion of the needle bar 1*c*. Describing the clutch mechanism which integrally couples the slider 30 with the guide member 19, a latch 31 is pivotally mounted on one side of the guide member 19 and has a bottom hook 31*a*. A spring 32 is disposed to urge the hook 31*a* to rotate counter-clockwise, whereby it is brought into engagement with a bottom step 30*a* formed in the slider 30 to maintain it latched resiliently. Under this condition, an elevating motion is imparted to the needle bar 1*c* through the slider 30. It is to be understood that the needle bar 1*c* is arranged such that it normally assumes its uppermost position and remains at such rest position when the slider 30 is disengaged from the latch 31 by the action of a lift spring 34 which is fixedly carried, at its one end, by a pin 33 secured to the arm 1*d* and which has its other end engaged with the guide member 19. The upper portion of the latch 31 is formed with a lateral projection 31*b* which is bent in the opposite direction from the direction in which the hook 31*a* extends. Means is provided which is controlled between a position in which it is engageable with the projection 31*b* and another position in which it is disengaged and spaced from the latter, and part of which, when it is located to be engageable with the projection 31*b*, guide it with its offset inner and outer edges to maintain the latch 31 in its unlatch position against the resilience of the spring 32. Specifically, a cam plate 36 is disposed below the guide supporter 21 and is pivotally mounted on a screw 35 so as to be rotatable in a horizontal plane relative to the arm 1*d*. At its right-hand end, the cam plate 36 is formed with a cam 36*a* which acts to guide the projection 31*b* on the latch member. The other end of the cam plate 36 is located opposite to the electromagnet 14 which is mounted within the arm 1*d* by means of a bracket 37. When the electromagnet 14 is energized to attract the cam plate 36, it rotates counter-clockwise, as viewed from the top, whereby the cam 36*a* is brought to a position where it is engageable with the latch projection 31*b* (see FIGS. 4 and 5). When the electromagnet 14 is deenergized, it turns clockwise, as viewed from the top, by means of a return spring, not shown, bringing the cam 36*a* to a position spaced from the projection 31*b* (see FIG. 3). It is to be noted that the cam plate 36 is formed of a flexible resilient material.

Figure 5:
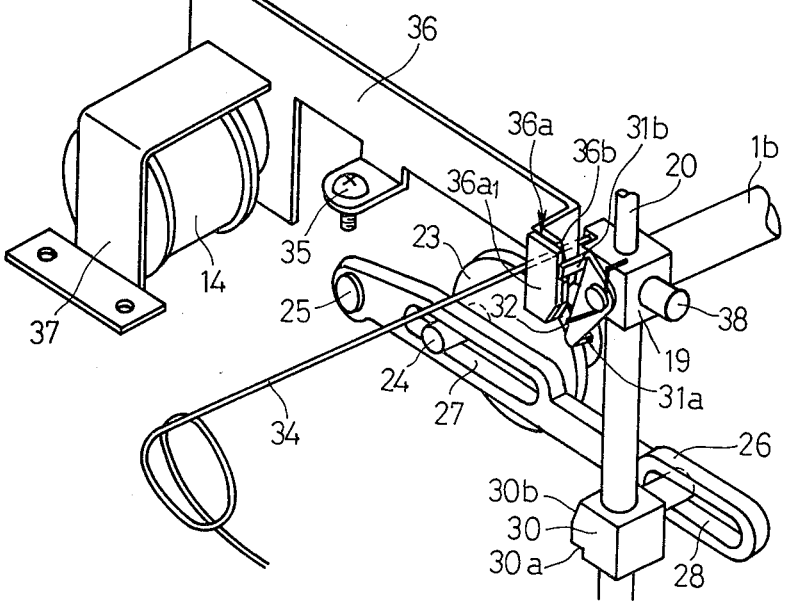
FIG. 5 is an enlarged perspective view of the electromagnetic clutch mechanism, illustrating a condition thereof when the drive arm is driven downward from its upper dead center shown in FIG. 4.

More specifically considering the action of the cam 36*a* to guide the latch projection, the right-hand end of the cam plate 36 is bent in the crank configuration, with the cam 36*a* which is formed at the free end thereof having secured thereto a small auxiliary piece 36*a*1 which is disposed on the outer side thereof so as to define an offset 36*b* in the cam 36*a*. The location of the offset 36*b* is in the upper portion of the cam 36*a*, and corresponds to the elevation of the projection 31*b* when the needle bar 1*c* assumes its rest position mentioned previously. The configuration of the offset is preferably a bevelled surface with retracts obliquely with an increasing elevation while the exposed surface of piece 36*a* 1 defines an abutment surface engageable with the end of the total projection 31*b*. At its front end, the bottom of the cam 36*a* is again formed as a bevelled surface which retracts with a decreasing elevation. If the electromagnet 14 is energized when the guide member 19 has been raised to its rest position, the resilient cam plate 36 will move angularly slightly to bring the abutment surface of the auxiliary piece 36*a*1 into abutment against the free end of the latch projection 31*b* in the region of the offset 36*b*, whereby the cam plate 36 will be flexed to remain in an unstable position temporarily. However, when the drive arm 26 oscillates to start a downward movement of the slider 30, the guide member 19 which is connected thereto through the latch 31 also begins to move down, and at a position which is slightly below the position shown in FIG. 4, the projection 31*b* will slip down inclined portion of the offset 36*b* to be pushed forward until the leading edge of the cam 36*a* is reached, whereby the bottom step 30*a* of the slider is unlatched from the latch hook 31*a*, as shown in FIG. 5. Although the slider 30 continues to move down, the guide member 19 returns to the rest position of the needle bar under the resilience of the lift spring 34, and simultaneously the resilience of the cam plate 36 which has been flexed causes the cam 36*a* to move nearer the guide member 19 to assure satisfactory camming position. In this manner, the projection 31*b* maintains the latch 31 in its unlatched position without being again engaged with the offset 36*b*. A bevelled surface 30*b* is formed on an upper portion of the side of the slider 30 on which the step 30*a* is provided. When the electromagnet 14 is deenergized and the latch 31 does not hold the slider 30 integrally, as the slider 30 moves toward the latch 31, the hook 31*a* of the latch engages and is guided by the bevelled surface 30*b* to cause a rotation of the latch 31, and when the guide member 19 moves into contact with the slider 30, the resilience of the spring 32 causes the hook 31*a* to engage the bottom step 30*a* of the slider.

Returning to FIGS. 2 and 3, a presser assembly 39 will be described which is guided and supported in the same manner as the needle bar 1*c* and which oscillates or elevates up and down in synchronized relationship with the needle bar 1*c* while preventing the latter against rotation. The presser assembly 39 which is used for embroidery sewing purpose is in the configuration of a long shank combined with a channel-shaped bottom portion. A slit 39*a* is formed in the shank so as to extend parallel to the needle bar 1*c* while the bottom portion is formed with a presser foot 39*b*. The assembly includes an upper end piece 39*c* through which the guide rod 20 slidably extends and also includes a middle step portion 39*d* through which the needle bar 1*c* slidably extends. A cloth presser spring 40 bears against the upper end piece 39*c* from above to urge the presser assembly normally downward. Lower portion of the shank 39*c* freely extends through a slot 22 formed in the lower wall of the arm 1*d*, whereby the portion of the presser assembly which is located below the step portion 39*d* is exposed outside the arm. A slide pin 38 is fixedly mounted on the front face of the guide member 19 and is slidably fitted into the slit 39*a*, whereby the guide member 19 is guided by the slit as it slides. During the elevating motion of the needle bar 1*c*, this guiding action prevents the needle bar from rotating.

The automatic embroidery sewing machine of the invention incorporates such needle bar drive apparatus which is of a drive pause control type. Before describing an embroidery stitching operation, the pause control of the needle bar drive apparatus will be described.

When the electromagnet 14 is deenergized, or when the cam 36*a* of the cam plate 36 is spaced from the knob 31*b* of the latch and hence is incapable of engagement therewith, the hook 31*a* of the latch 31 engages the bottom step 30*a* of the slider to latch it, whereby the guide member 19 is connected integrally with the slider 30. As the drive arm 26 oscillates in response to the rotation of the arm shaft 1*b*, the elevating motion which is transmitted to the slider 30 is directly imparted to the needle bar 1*c*. During the initial phase of the downward movement of the needle bar 1*c* from its upper rest position while causing a flexure of the lift spring 34, the presser assembly 39 moves from integrally with the guide member 19 under the resilience of the cloth presser spring 40. However, after the presser foot 39*b* bears against a cloth to be worked, not shown, the presser assembly 39 remains at such position while the needle bar 1*c* continues to move down to perform a stitch forming operation, which is well known in itself, by a cooperation between a needle 41 mounted on the lower end of the needle bar 1*c* with a shuttle assembly, not shown. During an upward stroke of the needle bar 1*c*, the needle 41 will be disengaged from the cloth during the later half of the stroke, and then the guide member 19 bears against the upper end piece 39*c* of the presser assembly to push it up, and thereafter both the needle bar 1*c* and the presser assembly 39 moves upward in an integral manner. During such portion of the upward stroke, the elevating motion of the presser assembly 39 in interlocked relationship with the needle bar 1*c* is continued as the arm shaft 1*b* rotates during the time the electromagnet 14 remains deenergized. During the stitching operation, a rotation of the needle bar 1*c* is prevented by the slide pin 38 which is guided by the slit 39*a* in the presser assembly 39.

When the electromagnet 14 is energized during the time when the arm shaft is being operated or ceases to operate, the attraction of the electromagnet causes an angular movement of the cam plate 36, whereby the cam 36*a* moves toward the guide rod 20 to a position where it is engageable with the latch 31. If the needle bar 1*c* assumes the rest position mentioned above at this time, the cam 36 will directly approaches the latch 31, whereby the offset 36*b* engages the projection 31*b* of the latch (see FIG. 4). Hence, the cam 36*a* cannot approach the guide member 19 sufficiently and remains at such position temporarily while causing a flexure of the cam plate 36. In this instance, as mentioned previously, during the initial phase of the downward movement of the drive arm 26, the projection 31*b* will slip down the offset 36*b* as the guide member 19 has slightly moved down, whereby the latch 31 oscillates to unlatch the slider 30, permitting the needle bar 1*c* to return to its rest position. Subsequently, if the arm shaft 22 continues to be driven, no stitch will be formed, merely causing a sliding movement of the slider 30 along the needle bar 1c. If the needle bar 1c assumes a position other than the rest position when the electromagnet 14 attracts the cam plate, the cam 36a is allowed to be displaced to its camming position with respect to the latch 31. If the drive arm 26 is then caused to oscillate to impart or continue an elevating motion to the needle bar, the projection 31b of the latch will engage the cam 36a from below immediately before the termination of the upward stroke of the needle bar 1c toward its rest position. Then the latch 31 rotates against the resilience of the spring 32 to disengage the hook 31a from the bottom step 30a of the slider, whereupon the projection 31b is retained and constrained by the leading edge of the cam 36a as shown in FIG. 5, thus maintaining the unlatched condition. Consequently, the needle bar 1c remains stationary at its rest position, and during such interval, a continued operation of the arm shaft 1b merely results in an elevating motion of the slider 30 as driven by the drive arm 26, forming no stitch.

A drive to the needle bar 1c is resumed by deenergizing the electromagnet 14 to release the projection 31b from the cam 36a. At this time, if the projection 31b is unlatched at the timing when the slider 30 assumes its uppermost position either accidentally or under the control of the unlatching operation in synchronized relationship with the rotation of the arm shaft, the hook 31a of the latch immediately catches and holds the bottom step 30a of the slider, whereby it is connected thereto. However, if the projection 31b is unlatched when the guide member 19 is spaced from the slider 30, as the bevelled surface 30b of the slider engages the hook 31a from below towrad the end of its upward stroke, the latch 31 is caused to rock against the resilience of the spring 32 to urge the hook 31a open as the slider reaches the end of its upward stroke. In this manner, the hook 31a catches and holds the bottom step 30a, completing the connection. The subsequent rotation of the arm shaft is effective to drive the needle bar 1c, reinitiating the formation of stitches by the needle 41.

Capitulating the control of the sewing machine for an increased stroke or feed of the cloth while utilizing the needle bar drive mechanism which is capable of interrupting a drive and which hence can be said as provided with a clutch mechanism, the timing when the elevating motion of the needle bar 1c is to be terminated or the timing to initiate the energization of the electromagnet 14 would be more practically chosen at a point slightly before the upper dead center is reached than the point in time when the needle 41 is disengaged from the cloth and the embroidery frame 5 begins to move during the later part of the upward stroke of the needle bar.

Figure 6:
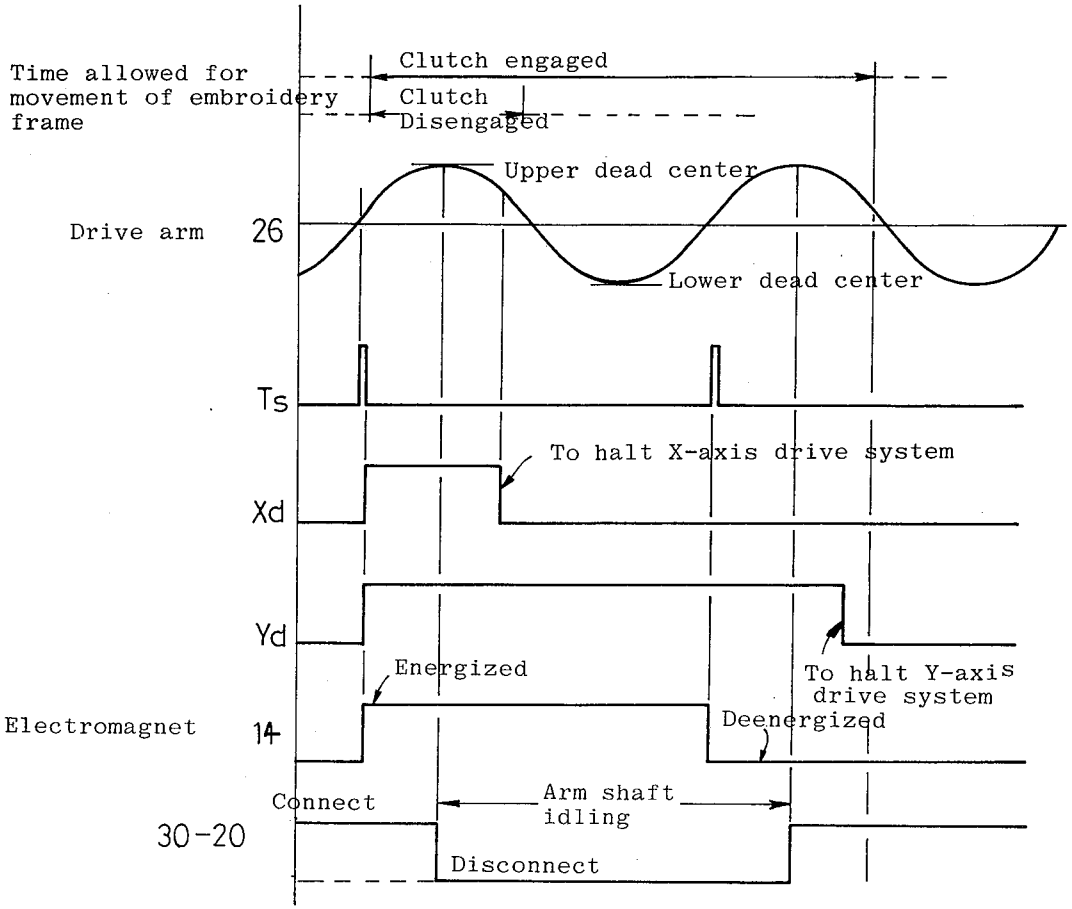
FIG. 6 is a timing chart indicating the timing when the electromagnetic clutch is energized or deenergized whenever the Y-axis component of the motion imparted to the embroidery frame exceeds a given value.
Figure 7:
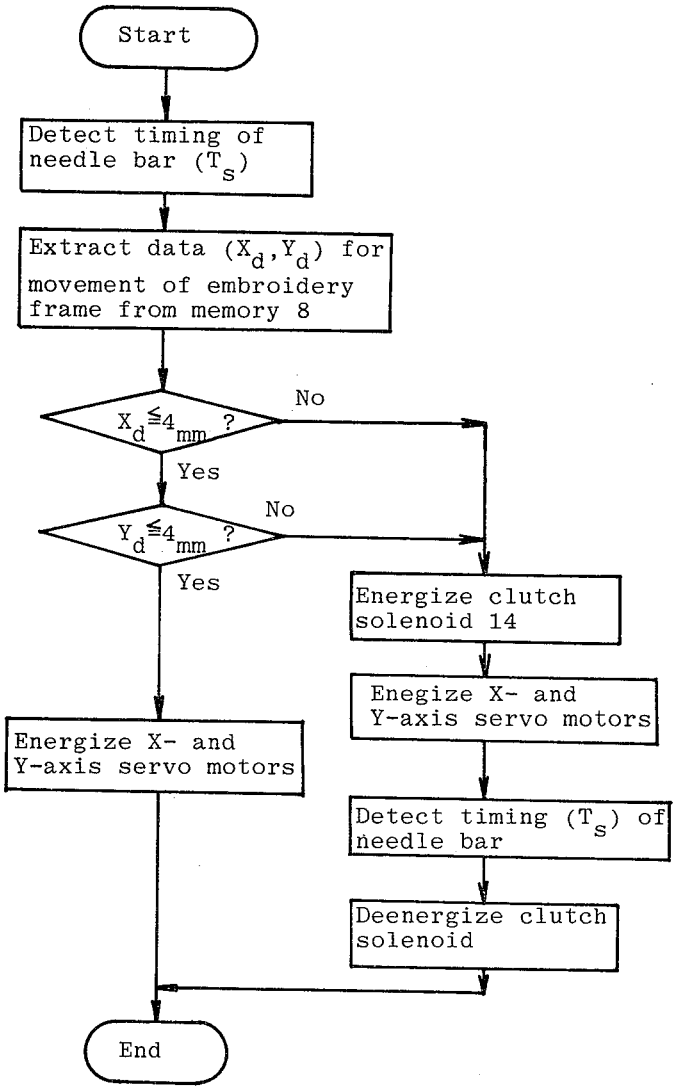
FIG. 7 is a flow chart illustrating the control of driving the embroidery frame for each stitch and of the energization of the electromagnetic clutch, both of which are effected by an electronic control system shown in FIG. 1.

Specifically, referring to FIG. 6, a timing signal Ts is produced by the rotation signal generator 13 at the time when the lower end of the needle 41 is disengaged from a throat plate and moves upward. In response to the timing signal, the X-axis and Y-axis servo motor 2, 3 begin to operate. If at least one of the X- and Y-axis component of the stroke over which the embroidery frame is to be moved, as supplied by the memory 8, exceeds a normal maximum value, the microcomputer 7 transmits an operating signal to the needle bar clutch drive circuit 11 simultaneously, thus energizing the electromagnet 14. This causes an angular movement of the cam plate 36, with the cam 36a being displaced to a position where it is engageable with the projection 31b to wait for the guide member 19 to move upward for engagement therewith. Immediately before the completion of the upward stroke to the upper dead center of the needle bar 1c, the hook 31a unlatches the slider 30, so that the guide member 19 is maintained in its upper position under the resilience of the lift spring 34, while the drive arm 26 causes only the slider 30 to move down. The arm shaft 1b continues its idling operation, and when the slider 30 reinitiates its upward stroke, the electromagnet 14 is deenergized at the timing when the timing signal Ts is produced. The cam 36a of the cam plate moves away from the latch 31, which is then subject to the action of the spring 32 to wait for the slider 30 so that the latter can be engaged by the hook 31a. When the slider 30 tends to bear against the guide member 19, the hook 31a becomes engaged with the bottom step 30a of the slider. Subsequently, when the slider 30 begins to move down, the needle bar 1c also reinitiates its downward movement. During the time the elevating motion of the needle bar 1c is halted for one cycle, the embroidery frame 5 is capable of a continued movement. The period of timing during which the movement of the embroidery frame 5 is permitted is limited to a maximum permissible period which is defined by a time interval from the reinitiation of the downward movement of the needle bar to a point in time which is immediately before the needle 41 pierces into the cloth. By operating the microcomputer 7 in this manner, it is possible to obtain a stroke of the embroidery frame during two revolutions of the arm shaft 1b which is as long as three times the maximum stroke in a normal stitching operation or even greater. If required, a further increase in the stroke of movement of the embroidery frame can be obtained by causing the arm shaft to idle for an increased length of time. FIG. 6 shows a timing chart which provides an increased stroke Yd for the Y-axis component of movement of the embroidery frame 5 by operating the Y-axis servo motor 3 over its full operable period. FIG. 7 shows a flow chart of a control sequence described above which is executed by the microcomputer 7.

As discussed above, in accordance with the invention, an elevating motion of the needle bar is temporarily halted during the operation of the sewing machine, and during the time the needle bar remains in its upper position, a movement of the embroidery frame is continued, thereby enabling an increased stroke of the embroidery frame for each stitch to be obtained without requiring servo motors of an increased capacity, by permitting them to be operative for an increased length of time up to a maximum permissible period. At this end, data which controls the movement of the embroidery frame is read out of the memory, and the servo motors are controlled in accordance with data for each stitch which is read out in synchronism with the rotation of the machine to continue the movement of the embroidery frame, thus performing an automatic embroidery sewing operation. In addition to such control of the operation, the microcomputer has the facility to control a pause in the elevating motion of the needle bar, to enable a stitch of an increased stroke, which occurs only infrequently during an entire embroidery operation, to be performed in a simple manner by utilizing the servo motors and the associated drive control circuit, both of an economical capacity.

Since various changes can be made in the above construction without departing from the scope of the invention, it is intended that all matters contained in the above description or shown in the accompanying drawings shall be interpreted as illustrative only, and not limitative.

Having thus set forth the nature of the invention, what is claimed is:

1. An automatic embroidery sewing machine comprising an X-axis drive system, a Y-axis drive system, a support member coupled with said drive systems and supporting an embroidery frame, a needle bar and a needle bar drive system, an electromagnetic clutch mechanism for selectively coupling and uncoupling said needle bar with said needle bar drive system and an electronic control system for driving embroidery sewing data which represents an X-axis component and a Y-axis component of a stroke over which the embroidery frame is to be driven along the X-axis and the Y-axis respectively, said data being utilized in the X-axis and Y-axis drive systems, said control system rendering said electromagnetic clutch mechanism in its operative condition for X and Y-axis components which are below respective given values and rendering the electromagnetic clutch mechanism inoperative until the termination of the positioning of the support member by the X and Y-axis drive systems whenever either component exceeds its associated given value, said electromagnetic clutch mechanism comprising a slider disposed in operative engagement with said needle bar drive system for imparting vertical reciprocatory motion to said slider, said slider being slidably mounted on said needle bar and having a bottom step portion, a latch member pivotally mounted on said needle bar at a point above said slider, said latch member having a laterally extending hook at one end adapted to engage said bottom step on said slider to operatively couple said needle bar to said slider and an oppositely extending lateral projection at the other end thereof, a spring angularly urging the latch member in a direction to be coupled with said slider, a resilient cam member having a cam surface formed on one end thereof and movable between a first position in which said cam surface is spaced from the latch member and a second position in which the cam surface engages part of the latch member, an electromagnetic assembly effective to drive the cam member from said first to said second position whenever energized wherein the electronic control system operates to maintain the electromagnetic assembly deenergized whenever both components of the stroke are below the given values and to energize the electromagnet assembly whenever either component of the stroke exceeds the associated given value and subsequently deenergizes it after the termination of the operation of the X and Y-axis drive system to position the support member for a stitch, said cam surface having a lower portion inclined downwardly away from said lateral projection on said latch member and an upper cam surface having a first vertically extending portion and a second inclined portion extending upwardly away from said lateral projection, said first and second portions being disposed side-by-side with said second inclined portion being offset to define an abutment surface between said first and second portions whereby upon energization of said electromagnet assembly when said needle bar is in its uppermost position, the abutment surface on said cam member will engage the end of said lateral projection on said latch member so that upon downward movement of said needle bar, said lateral projection will engage said second inclined portion of said cam surface to pivot said latch member out of engagement with said step portion on said slider to disengage said needle bar from said needle bar drive system.

2. An automatic embroidery sewing machine as set forth in claim 1 further comprising spring means connected between said sewing machine and said needle bar for raising said needle bar to the uppermost position after said latch member is disengaged from said slider with said lateral projection on said latch member disposed in engagement with said first portion of said cam surface for maintaining said hook out of engagement with said slider upon subsequent reciprocatory movement of said slider while said electromagnetic assembly is energized.

3. An automatic embroidery sewing machine as set forth in claim 2, wherein said slider is further provided with a beveled cam surface on the side thereof directly above said bottom step whereby upon deenergizing said electromagnet assembly said hook on said latch member will engage said beveled surface upon upward movement of said slider to guide said hook along the side of said slider for engagement with said bottom step to couple said needle bar to said slider.

* * * * *